United States Patent [19]

Hoffmann et al.

[11] Patent Number: 4,517,695

[45] Date of Patent: May 21, 1985

[54] METHOD AND APPARATUS FOR BALANCING OF OUT-OF-BALANCE FORCES IN CENTRIFUGES OR COMBINED WASHING MACHINES-SPIN DRIERS

[76] Inventors: Ernst H. Hoffmann, Im Defdahl 311, 4600 Dortmund 1; Hans F. Arendt, Industriestrasse 32, 7126 Sersheim, both of Fed. Rep. of Germany; Leonhard Spiewok, Zielackerstrasse 19, CH-8304 Wallisellen; Jakob Rettich, Kilchbergstrasse 129, CH-8038 Zürich, both of Switzerland

[21] Appl. No.: 435,033

[22] Filed: Oct. 18, 1982

[30] Foreign Application Priority Data

Oct. 22, 1981 [DE] Fed. Rep. of Germany ..... 3141901

[51] Int. Cl.[3] ..... D06F 23/02; D06F 33/02

[52] U.S. Cl. ..... 8/158; 68/12 R; 68/23.1; 210/144

[58] Field of Search ..... 8/158; 68/12 R, 23.1; 210/144

[56] References Cited

U.S. PATENT DOCUMENTS

| | | | |
|---|---|---|---|
| 3,152,462 | 10/1964 | Elliott et al. | 68/12 R |
| 3,226,960 | 1/1966 | Mellinger | 68/23.1 |
| 3,285,419 | 11/1966 | Smith | 68/23.1 X |
| 3,324,691 | 6/1967 | Smith | 68/23.1 |
| 3,583,182 | 6/1971 | Matsuura | 68/23.1 |

*Primary Examiner*—Philip R. Coe
*Attorney, Agent, or Firm*—Horst M. Kasper

[57] ABSTRACT

A method and apparatus for balancing of out-of-balance forces in centrifuges or combined washing machines-spin driers comprising a drum with horizontal rotation axis initially being brought to a relatively low speed of rotation, which is at least of the magnitude such that all laundry clings to the drum wall. At this rotation speed the out-of-balance force is measured and compared with a set value. This set value is selected to be of such size that its out-of-balance force surpasses the permissible out-of-balance force, projected to the final rotary spinning speed, by at least 30 percent. If such a value surpassing the permissible out-of-balance force was measured as a value disposed below the set value, then the acceleration to the final rotary spinning speed is turned on. This is stopped when the permissible out-of-balance force is reached, and the drum is operated for a certain time at an approximately constant rotation speed, where due to a slow flowing of the clothes a substantial decrease of the out-of-balance force occurs. The drum is brought to the final rotary spinning speed after this decrease. The set value can be selected of such a magnitude that upon an acceleration to the final rotary spinning speed without intermediate stop, the permissible value of the out-of-balance force would be surpassed by as much as four times.

13 Claims, 2 Drawing Figures

METHOD AND APPARATUS FOR BALANCING OF OUT-OF-BALANCE FORCES IN CENTRIFUGES OR COMBINED WASHING MACHINES-SPIN DRIERS

BACKGROUND OF THE INVENTION

1. Field of the Invention

The invention relates to a method and apparatus for balancing the out-of balance forces in centrifuges or combined washing machines-spin driers with a monitoring provision, which interrupts the regular acceleration of the drum to the final rotary spinning speed if out-of-balance forces are to large.

2. Brief Description of the Background of the Invention Including Prior Art

In order to avoid destruction and damage to centrifuges, the use of monitoring provisions to switch off the drive is known. A known improvement of such machines does not switch off the drive completely, but lowers the rotation speed to such an extent that the clothes in a drum with a horizontal rotation axis release from the drum wall shortly before reaching the highest point of the drum wall and fall along a free flight path into the lower part of the drum. If the rotation speed is increased slowly, then the free flight path disappears and all the clothes cling again like a ring to the drum. By way of the free flight path the clothes have been redistributed and in most cases out-of-balance forces have been balanced by this step such that the drum can then be accelerated to the final rotary spinning speed. It has been found that despite the free flight path the clothes sometimes still retain out-of-balance distributions, since a clothes piece can wind up to a ball-shaped tangle during the washing procedure. Such a tangle remains in the lower part of the drum upon beginning of clinging to the drum and it rotates there like a ball such that it never reaches the upper part of the drum and never passes into the free flight path.

SUMMARY OF THE INVENTION

1. Purposes of the Invention

It is an object of the present invention to provide a method for achieving a balancing of out-of balance forces in centrifuges or combined washing machines-spin driers.

It is a further object of the present invention to provide for an improvement in the balancing of machines which reach a substantially balanced clinging of the clothes to the drum based on a free flight path, where this effect occasionally fails in the case of nearly spherical tangles.

It is another object of the invention to provide a spin drying machine suitable as a centrifuge or as a combined washing machine-spin drier which allows a balancing of the forces caused by non-uniform distribution of the materials in the drum of the machine.

These and other objects and advantages of the present invention will become evident from the description which follows.

2. Brief Description of the Invention

The present invention provides a method for balancing out-of-balance forces in a centrifuge or a combined washing machine-spin drier which comprises activating an out-of-balance monitoring section, which interrupts the regular acceleration of the drum to the final rotary spinning speed if the imbalance is too large, running the drum of the centrifuge or combined washing machine-spin drier up to a certain speed, and interrupting the acceleration by maintaining the rotation speed of the drum in a region for a certain time, where the upper limit of the region is determined by the rotary speed which causes the maximum permissible out-of-balance force and where the lower limit of the region is determined by double the rotary speed at which the clothes cling to the jacket against the force of gravity. The dwell time in this operation continues until a maximum permissible out-of-balance force is not exceeded upon further acceleration.

A maximum value of the dwell time at a rotation speed in the vicinity of the maximum out-of-balance force can be set. The drum can be braked upon reaching the maximum value of the dwell time and the drum can be emptied. Upon interrupting the acceleration the rotation speed of the drum can be kept in a region which is from about 50 to 85 percent of the maximum final rotary spinning speed. After reaching a maximum permissible out-of-balance force, the regularly prevailing rotary acceleration can be reduced substantially, can be removed completely, or can be changed in direction.

This invention also provides a spin-drying machine which comprises: a drum with a horizontal axis of rotation, a drive connected to the drum for providing rotary power to the drum, a monitoring provision for surveying the out-of-balance forces of the drum during rotation, a control device connected to the monitoring provision and to the drive, and a comparison device connected to the monitoring provision. The control device and the comparison device provide for an interruption of the acceleration to the final rotary spinning speed and they are set in the region from to one third of the final rotary spinning speed to a predetermined value of the out-of-balance force, respectively.

The spin drying machine can be part of a washing machine-spin drier combination or a centrifuge. The part of the drum contacted by the filling of the drum with clothes above the rotary speed resulting in clinging to the drum wall results upon provision of a longitudinal section along the rotation axis in a substantially continuously running curved line, which coming from each of the front faces of the drum increases continuously the distance from the rotation axis and which has the largest distance value over the middle of the real or conceptual axis of the drum.

The features which are considered novel as to the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, which shows one of the various possible embodiments of the present invention.

DESCRIPTION OF INVENTION AND PREFERRED EMBODIMENTS

The present invention provides a method for balancing the out-of-balance forces in centrifuges or combined washing machines and spin drying machines with a montoring provision for the out-of-balance forces of the drum, which interrupts the regular acceleration of the drum to the final rotary spinning speed. The interruption of the regular acceleration causes the rotation speed of the drum to be maintained in a region over a certain time, where the upper limit of the region is determined by the rotary speed causing the maximum permissible out-of-balance force, and where the lower limit is twice the rotational speed required to offset gravity for horizontal axia drums. The dwell time in this operation continues until the maximum permissible out-of-balance forces are not surpassed.

This solution provided by the present invention applies to all known spin driers or washing machine-spin drier combinations. It is particularly advantageous in cases of machines with a drum having a horizontal rotation axis, wherein a distribution substantially free of unbalancing of the clothes is provided at a lower rotation speed in a free flight path. In a few cases, the maximum permissible out-of-balance force is reached at spin speeds exceeding half the final spin speed. It has been found that most of the out-of-balance forces decrease or balance at higher rotation speed, if it is maintained for a certain time in the neighborhood of the rotation speed, at which the clothes start to flow due to the centrifugal forces and thus reduce the out-of-balance forces. This balancing of the out-of-balance forces can be explained by a slow flow behavior of the clothes. A ball-shaped tangle penetrates slowly into the clothes and pushes them to the side and this results in a mass balancing.

In rare cases the tangle becomes so large that a complete balancing cannot achieved by way of the flow behavior of the laundry. It is appropriate in such a case that after a maximum dwell time at a rotation speed close to the maximum determined by the allowable out-of-balance force, the drum is braked and emptied.

Figure 2:
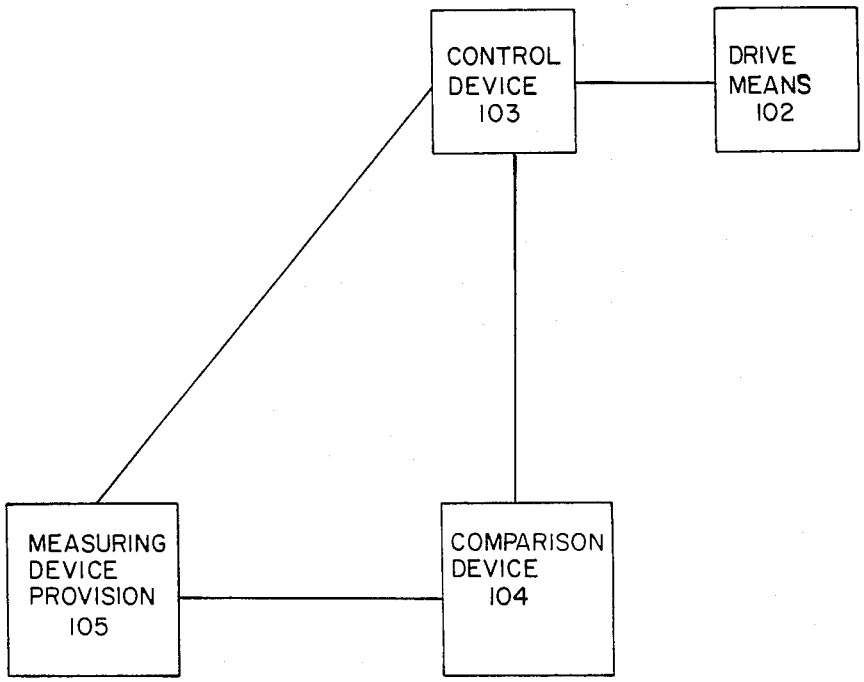
FIG. 2 is a view of a schematic circuit diagram according to the pressent invention.

The invention also provides a centrifuge or combined washing and spinning machine utilizing a drum with horizontal rotary axis, a device for monitoring the out-of-balance forces, a control device, and a comparison device which are connected to each other as in FIG. 2. Surpassing of a preset value of the out-of-balance force causes an interruption of the acceleration to the final rotary spinning speed. The comparison device is set to a predetermined value of the out-of-balance force at speeds below one third of the final rotary spinning speed. This pregiven value may be mathematically projected to the final rotary spinning speed, and if the projected force surpasses the allowable value by more than 30 percent, the same or additional control and comparison devices are switched on for surveying the out-of-balance force at spin speeds exceeding 40 percent of the final speed. In this region the comparison device is set to a predetermined value between 70 and 100 percent of the permissible out-of-balance force at the rotation speed reached in each case, where the control device upon reaching of the preset value shuts off the regular acceleration of the drum to maintain constant rotation speed or a slow time dependent change in speed in a positive or a negative sense. A slow change being defined less than 20 percent of the prevailing rotary acceleration at that rotation speed. The control device causes acceleration to resume after 30 seconds, and the aforementioned process is repeated.

Figure 1:
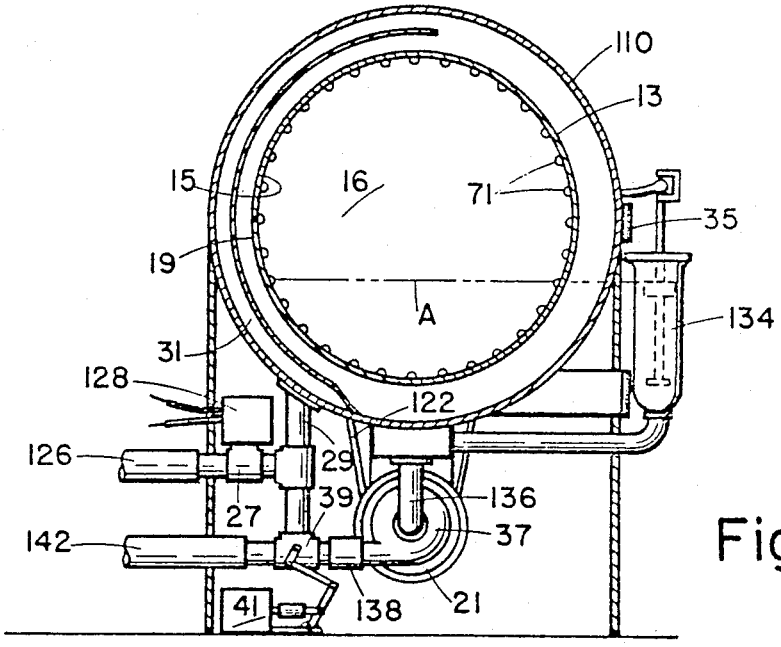
FIG. 1 is an in part sectional view of a washing machine-spin drier combination suitable in the system of the present invention.

This apparatus comprises a combined washing machine and spin drier machine with a drum with horizontal axis. FIG. 1 shows a combination washing machine-spin dryer. Water at a desired temperature is admitted to a tub 110 from a suitable source via conduit 126. The water flow can be controlled by an electrically operated valve 27, with the valve normally being closed and capable of being moved to its open position by a solenoid 128. The downstream side of the valve 27 is connected via conduit 29 to a water passage 31 formed in the tub 110 structure and terminates at the upper end of the tub structure for feeding water to the tub.

A perforated drum or basket 13 is arranged within the tub 110 having an axis of rotation disposed substantially horizontal, around which the drum 13 can be rotated. The drum 13 includes a partly cylindrical side wall 15, which is preferably tapered toward the ends with an end wall 16 provided with perforations for allowing separation of the water from the clothes.

Protrusions 71 are provided on the side wall 15 to prevent the clothes from sliding along the wall upon rotation of the drum. In addition the protrusions can serve to agitate the laundry during the washing cycle.

A motor 21 is provided for rotating the drum 13. Preferably the motor 21 is disposed below the tub 10 and connected via a belts 122 to a pulley attached to the drum axis.

The level of fluid in the tub 110 during the washing cycle is indicated by the dash-dotted line A. A conventional float switch structure 134 can be employed for controlling the amount of water admitted to the tub 10 and it actuates switch 35 to its open position when the proper amount of water has been admitted to the tub. When the tub is substantially devoid of water the float actuated switch 35 is moved to the closed position. The switch 35 is connected in series with the solenoid 128.

The operation of the motor 2 and of the electromagnets 128, 41 may be by hand or controlled automatically such as by way of a microprocessor. When the proper amount of water has been admitted the the tub 10 as indicated by the dash-dotted line A, the float switch is actuated to its open position, whereby the magnet 128 is deenergized and the valve 27 is closed. At this time the pump 37 functions to withdraw water from the tub and convey it through conduit 138, the two way valve 39 and eventually the water passage 31 into the drum through circumferentially spaced openings 19.

The number of protrusions is preferably more than 10 per square decimeter of the inner surface of the drum.

As shown in FIG. 2, the motor 102 is connected to a control device 103 for controlling the speed of the motor 102. The control device 103 in turn is connected to a comparison device 104 and a monitoring provision 105. The comparison device receives the monitored signal from the monitoring provision and compares it with a value previously set. If the monitored out-of-balance value exceeds the preset relative value and/or a respective ratio, then the acceleration of the rotating drum is interrupted.

The clothes are washed in this machine at a low rotation speed. Before the beginning of the spinning operation the rotation speed is increased just such that the clothes shortly before the uppermost position of the drum peel off the wall and fall along a free flight path into the lower part of the drum, where no amount worth of water is present. If the rotation speed is now slowly increased, then the clothes cling substantially without out-of-balance forces as a ring to the drum, as is known. At this rotation speed of clinging, or slightly above the same, advantageously the out-of-balance force is measured according to a known measurement procedure. The corresponding resulting out-of-balance force at the final rotary spinning speed is calculated from the measured value of the out-of-balance force with the aid of a microcomputer. This calculated value is compared with the permissible value in a comparison device. If it reaches for example double the permissible value, then the control device nevertheless provides the signal for the acceleration of the drum. This acceleration, however, is interrupted at less than the final rotary spinning speed by the same or another device monitoring the out-of-balance forces. The drum is maintained, for example, for 30 seconds by means of a time switch and a rotation speed control contained in the control device at 50 to 85 percent of the final rotary spinning speed. After these 30 seconds the control provision turns the regular acceleration procedure on up to the final rotary spinning speed. These 30 seconds can be shortened, if the monitor device for the out-of-balance force has provided the signal to the control device, that the out-of-balance force has decreased to half or less, for example. The circuit is equipped with conventional means so that an acceleration does not occur, if the out-of-balance force is still disposed at the limit of the permissible value. In such a very rare case the rotation speed is braked and the clothes are tilted and/or taken out of the drum, and the cause of the out-of-balance force is investigated by hand. The computer can also be eliminated from the apparatus if the permissible value of the out-of-balance force at the final rotary spinning speed is projected from the rotation speed with clinging and the measured value of the out-of-balance force at the speed of clinging is compared directly to the projected value in the comparator device. The measured out-of-balance force can also be determined at higher rotation speeds instead of the speed of clinging and then be compared. The rotation speed of clinging of the clothes, at which just no clothes are in a free flight path, represents the lowest possible value for the determination of the out-of-balance force.

If the measured out-of-balance force results in a one-sixth or a less permissible value as projected for the final rotary spinning speed, then this extreme out-of-balance cannot be balanced by the flowing of the clothes at a reduced rotation speed. In such a case the clinging process is repeated again or the drum is stopped and emptied.

Which predetermined value of the maximum force is to be considered in the comparison device below of one third of the final rotary spinning speed depends on the kind of clothes or laundry, the diameter of the drum and the shape of the drum. At a diameter of 20 millimeters of the drum, inclined front faces and short length of construction, the upper limit of the predetermined value is about one fifth the permissible value of the out-of-balance force relative to the final rotary spinning speed.

The flowing of the laundry and thus a decrease of the out-of-balance force can be favored in particular by the shape of the drum, and a speed of more than 50 percent of the final rotary spinning speed. At any rate, it is advantageous if the front face of the drum runs inclined tapered to the outside with respect to the rotation axis. However, this inclined area has to be present only near the front face, where the laundry is disposed after the clinging. The remaining area of the front face can run vertically with respect to the rotation axis. It is further advantageous, if the middle cylindrical part of the drum corresponds to at most about one third of the total drum length. An ideal shape of the drum would be provided by a rotatating chain. This shape, as well as a shape with straight line inclined front faces, favors balancing in cases where the tangle is disposed closely to the front face of the drum. It is a further advantage, if the drum is short as compared to its diameter.

It will be understood that each of the elements described above, or two or more together, may also find a useful application in other types of washing and spin drying system configurations and centrifuging procedures differing from the types described above.

While the invention has been illustrated and described as embodied in the context of a washing machine-spin drier combination, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for balancing of out-of balance forces in a centrifuge drier or a combined washing machine-spin drier with a drum having a substantially horizontal rotation axis comprising:

accelerating the drum of the drier to a first rotation speed at which the objects to be dried cling substantially to the drum against the force of gravity;

measuring the value of the out-of-balance force at said first rotation speed;

calculating the resulting out-of-balance force at a final rotation speed of the drum from the measured value of the out-of-balance force at the first rotation speed;

presetting a maximum out-of-balance force at the final rotation speed;

accelerating the drum to said final rotation speed if the calculated resulting out-of-balance force does not exceed a preset maximum out-of-balance force at the final rotation speed;

accelerating the drum to a second rotation speed being lower than the final rotation speed if the calculated resulting out-of-balance force exceeds the preset maximum out-of-balance force, and substantially maintaining the rotation speed in the region of said second rotation speed for a certain dwell time, which time is sufficient for a decrease of the out-of-balance force to such a degree that, at the final rotation speed, the maximum out-of-balance force is not exceeded, and after said time, accelerating the drum to the final rotation speed.

2. The method according to claim 1 further comprising:

presetting a maximum value of the dwell time at said second rotation speed.

3. The method according to claim 2 further comprising:

measuring the out-of-balance force during the dwell time at said second rotation speed, and braking the drum upon reaching said maximum value of the dwell time in case the measured out-of-balance force exceeds a predetermined maximum value at said maximum value of the dwell time.

4. The method according to claim 2 further comprising:

measuring the out-of-balance force during the dwell time at said second rotation speed, and accelerating the drum to the final rotation speed as soon as the measured out-of-balance force decreases below a predetermined minimum value.

5. The method according to claim 1 wherein the second rotation speed of the drum is selected between 50 percent and 85 percent of the final rotation speed.

6. The method according to claim 1 further comprising:

measuring the out-of-balance force continuously during acceleration, and interrupting the acceleration as soon as the actually measured out-of-balance force exceeds a maximum permissible value of the out-of-balance force.

7. The method according to claim 6 wherein the maximum permissible value of the out-of-balance force is set below said preset maximum value.

8. The method according to claim 1 further comprising:

stopping the rotation of the drum when rotating at said first rotation speed as soon as the calculated resulting out-of-balance force exceeds an upper limit which is higher than a maximum permissible out-of-balance force and said preset maximum value.

9. A centrifuge drier or combined washing machine-spin drier comprising:

a drum having a horizontal axis of rotation;

a drive means connected to the drum for rotating the drum at a variable rotation speed;

a measuring device for measuring the value of the out-of-balance force of the drum;

a comparison device providing output signals depending on whether the measured values of the out-of-balance force exceed previously set values or not;

a control device connected to said comparison device which controls said drive means, said control device comprising;

means for accelerating the drum to a first rotation speed at which the objects to be dried cling substantially to the drum against the force of gravity;

means for further accelerating the drum to a final rotation speed if the comparison device provides an output signal indicating that the out-of-balance force at the final rotation speed projected from the measured value at said first rotation speed does not exceed a preset maximum out-of-balance force at the final rotation speed; and means for accelerating the drum up to a second rotation speed which is lower than the final rotation speed and substantially maintaining the rotation speed in the region of said second rotation speed for a certain dwell time if the comparison device provides an output signal indicating that the out-of-balance force at the final rotation speed projected from the measured value at said first rotation speed exceeds the preset maximum out-of-balance force at the final rotation speed and, after said dwell time, continuing acceleration of the drum to the final rotation speed.

10. The drier according to claim 9 the control device of which further comprising:

means for stopping the drum when rotating at said first rotation speed if the comparison device provides an output signal indicating that the out-of-balance force at the final rotation speed projected from the measured value at said first rotation speed exceeds an upper limit which is higher than said preset maximum out-of-balance force.

11. The drier according to claim 9 the control device of which further comprising:

calculating means for projecting an actually measured out-of-balance force at a certain rotation speed to a value which it would achieve at the final rotation speed.

12. The drier according to claim 9, the control device of which being connected directly to the measuring device, and comprising:

means for interrupting the acceleration of the drum as soon as the measuring device indicates that the actual out-of-balance force has been exceeded, which upper limit is higher than the preset maximum out-of-balance force.

13. A method for balancing out-of-balance forces in a centrifuge drier of a combined washing machine-spin drier with a drum having a substantially horizontal rotation axis comprising measuring the out-of-balance of the machine with a measuring device; feeding signals from the measuring device to a control and balancing means;

determining in the comparision means if a preset value of the out-of-balance forces has been surpassed;

establishing a second pre-set value in a rotation range below one third of the final rotation speed;

adjusting the measuring device in said rotary range to a predetermined value of the out-of-balance forces, is proportional to one hundred thirty percent of the maximum permissible out-of-balance force at the final rotational speed;

interrupting the acceleration to the final rotation speed; and switching off the drive of the drier upon surpassing of this second pre-set value.

* * * * *